US006398274B1

(12) United States Patent
Huang et al.

(10) Patent No.: US 6,398,274 B1
(45) Date of Patent: Jun. 4, 2002

(54) RETRACTING SPINDLE FOR MORTISE LOCK

(75) Inventors: Richard H. Huang, New Haven, CT (US); Ronald S. Slusarski, Narragansett, RI (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 09/443,770

(22) Filed: Nov. 19, 1999

(51) Int. Cl.[7] ..... E05B 3/00
(52) U.S. Cl. ..... 292/358; 292/348
(58) Field of Search ..... 292/348, 358, 292/359, 336.3, DIG. 60, DIG. 61; 403/109.1, 109.3, 109.6, 325, 327

(56) References Cited

U.S. PATENT DOCUMENTS 1,672,711 A 6/1928 Cummins
1,821,682 A 9/1931 Westrope
1,864,342 A 6/1932 Devereaux
1,896,509 A 2/1933 Carmichael et al.
3,211,486 A 10/1965 Crandell
3,261,630 A 7/1966 Chew
5,177,987 A 1/1993 Shen
5,813,708 A 9/1998 Shen

*Primary Examiner*—Gary Estremsky
(74) *Attorney, Agent, or Firm*—Delio & Peterson, LLC

(57) ABSTRACT

A retracting spindle mechanism has a spindle that extends between a handle trim mechanism mounted on the face of a door and a mortised door lock. The spindle is rotated by the handle to operate the door lock and slides axially in a hub to accommodate doors of different thicknesses. A conical spring is used to urge the spindle to the extended position. The conical spring can be compressed until it is flat allowing the spindle mechanism to be used in trim mechanisms with paddle handles having limited space between the handle and the mortised lock mechanism. A pin extends transversely through the spindle and into a slot in the hub capturing the spring and holding the spindle mechanism together as an integral assembly.

19 Claims, 2 Drawing Sheets

RETRACTING SPINDLE FOR MORTISE LOCK

BACKGROUND OF THE INVENTION

1. Field of the Invention

The present invention relates to door locks, particularly mortise locks, in which a trim mechanism mounted on the surface of the door has a handle turning a spindle that extends into the door to operate a lock mechanism mounted therein. More specifically, the present invention relates to the spindle that extends between the trim mechanism and the lock mechanism when the distance between those two mechanisms varies due to varying door thicknesses.

2. Description of Related Art

Mortise locks typically have a pair of trim mechanisms mounted on opposite faces of a door to operate the lock mechanism mortised into the door. The lock mechanism includes a latchbolt that engages the door frame to latch the door closed and the trim mechanisms include corresponding handles that allow the user to open the door by retracting the latchbolt when the door is unlocked.

In this type of design, the retraction of the latchbolt into the lock mechanism is achieved by operating a handle which turns a spindle extending from the trim mechanism to the lock mechanism. Different types of handles may be incorporated into the trim mechanism, such as lever handles, conventional knob handles, and paddle handles, etc., depending upon the intended use of the door. Knob handles are commonly used in private buildings. Lever handles are often used in public buildings and paddle handles are often found in hospitals or other locations where it is desirable to operate the door without grasping the handle with the hand.

In lever handles and knob handles, the spindle is usually turned directly by the handle. Rotating the handle turns the spindle which operates the lock mechanism. In paddle handles, there is a linkage or cam mechanism that converts an inward motion of the handle to spindle rotation.

In mortise locks, the lock mechanism is mounted halfway between the two opposed faces of the door (at the midplane of the door), and the handle trim mechanisms are surface mounted on the opposed faces of the door. Because doors can have different thicknesses, the distance from the face of the door to the midplane of the door will vary. Accordingly, the length of the spindle also varies, as it must correspond to the thickness of the door. The correct length for the spindle is particularly important for mortise locks that are designed with a pair of independent coaxial spindle hubs. This design allows handles on opposite sides of the door to be locked and operated independently.

With a pair of independent spindle hubs, the hubs are symmetrically located within the lock mechanism on opposite sides of the midplane of the door and the spindle from each trim mechanism cannot extend past the door midplane. If a spindle is too short, it will not fully engage its corresponding spindle hub. Alternatively, if the spindle is too long, it will bind and may jam the locking mechanism or the trim mechanism. The spindle length must be correct for the door thickness.

The need to match the spindle length to the door thickness is inconvenient, as the installer of the door lock must know the thickness of the door. It is also inconvenient for the supplier who must supply multiple spindles to match different door thicknesses or require that the purchaser specify the door thickness when the lock is purchased. Errors in selecting and installing the correct spindle are common and result in locks that jam, bind or fail to operate correctly. A related problem is that removable or replaceable spindles may fall out during handling or become misplaced before or during installation.

The present invention relates to solving the above problems where the lock mechanism is mounted at the door midplane and has surface mounted trim mechanisms on opposite sides of the door. It is specifically directed to the case where the trim mechanisms have independent spindles and where the spindles cannot extend beyond some maximum depth, to prevent binding, but must extend to at least some minimum depth to properly engage the lock mechanism. The invention is particularly suitable for the case where the spindle must be relatively short or where the trim mechanism provides very limited space for the spindle and related linkages or cams.

One example of a trim mechanism that has limited space is paddle trim. Paddle trim is often used in hospitals, restaurants, washrooms and public buildings where it is desirable to be able to open the door simply by pressing inward on the handle without contacting it with the hand. Paddle trim handle mechanisms permit the door to be opened by contacting the paddle handle with the elbow, the hip, etc. and does not require the hands to be free, nor does it require a handle to be turned or gripped with any force.

Because the paddle handle moves inward to open the door, paddle trim mechanisms use a cam hub that converts the inward motion of the paddle handle to a rotational motion of the spindle. A consequence of this design is that it severely limits the maximum length of the spindle. In more conventional trim mechanisms that do not require this conversion from inward to rotational motion, the spindle may project axially into the rotating knob or lever handle. In the paddle handle design, this is not practical and this limitation on the space available for the spindle makes it difficult to construct any type of mechanism to vary the length of the spindle as needed to accommodate the varying door thicknesses.

Bearing in mind the problems and deficiencies of the prior art, it is therefore an object of the present invention to provide a retracting spindle mechanism for operating a door lock which automatically extends and retracts to accommodate different door thicknesses.

It is another object of the present invention to provide a retracting spindle mechanism for operating a door lock which comprises a single assembly and does not have separate loose parts.

A further object of the invention is to provide a retracting spindle mechanism for operating a door lock which fits within a limited depth.

It is yet another object of the present invention to provide a retracting spindle mechanism for operating a door lock which is suitable for use with a paddle handle trim mechanism.

Still other objects and advantages of the invention will in part be obvious and will in part be apparent from the specification.

SUMMARY OF THE INVENTION

The above and other objects, which will be apparent to those skilled in art, are achieved in the present invention which is directed to a retracting spindle mechanism for operating a door lock and to a handle trim mechanism incorporating the retracting spindle mechanism.

The retracting spindle mechanism includes a spindle having one end adapted to operate the door lock and another end driven by a trim mechanism handle. A pin is mounted in the spindle and a hub has a slot and an axial opening formed therein. The cross sectional shape of the axial opening is such that the spindle is engaged by the axial opening to rotate with the hub. The axial opening is sufficiently deep to allow the spindle to slide axially therein. The pin is engaged by the slot in the hub to retain the spindle in the axial opening. A spring surrounds a first portion of the hub, and the spring exerts an outward force on the spindle through the pin.

The spring is preferably a conical spring with progressively smaller coils. Each coil has an inner diameter and an outer diameter, and the inner diameter of each coil is at least as large as the outer diameter of each smaller coil in the spring. This allows the spring to collapse until it is approximately flat, thereby using very little space.

When the invention is to be used in a paddle handle trim mechanism, the hub includes a cam formed thereon which may have a roller on it to reduce friction. The cam and roller allow the pivoting action of the paddle handle to be converted into rotation of the spindle. The conical spring is particularly suitable for this implementation of the invention as it allows the maximum length and retracting motion for the spindle within the extremely limited space available between the paddle handle in the trim mechanism and the lock mechanism.

In one aspect of the invention, the slot extends transversely through the axial opening in the hub forming a pair of opposed slot openings in the hub. The pin extends through the opposed slot openings and transversely outward from opposite sides of the hub. The conical spring has a large end and a small end with the small end of the conical spring contacting the pin on opposite sides of the hub.

The invention also includes the retracting spindle mechanism in combination with a handle trim mechanism. In this combination, the handle trim mechanism includes a mounting plate for mounting to the exterior of a door, and a handle mounted to the mounting plate for motion between an open position and a closed position. The hub of the retracting spindle mechanism is rotatably mounted to the mounting plate and the handle rotates the hub as the handle moves between the open position and the closed position. The spring is positioned between the mounting plate and the pin to urge the spindle outwards and into full engagement with the lock mechanism.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–3 of the drawings in which like numerals refer to like features of the invention.

Figure 1:
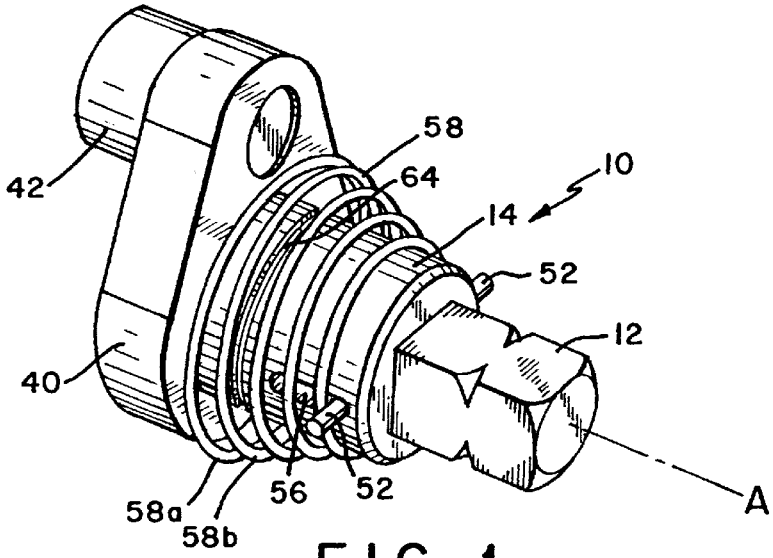
FIG. 1 is a perspective view of the retracting spindle mechanism according to the present invention.

FIG. 1 shows a retracting spindle mechanism 10 constructed according to the invention which includes a spindle 12 having an axis A. The spindle 12 slides axially in hub 14. The retracting spindle mechanism 10 shown in FIG. 1 is particularly adapted for use in a paddle trim mechanism 16 shown in the exploded view of FIG. 2. The paddle trim mechanism 16 includes a paddle handle 18 that pivots on handle pivot 20 and ultimately rotates spindle 12 to open a mortised door lock.

Figure 2:
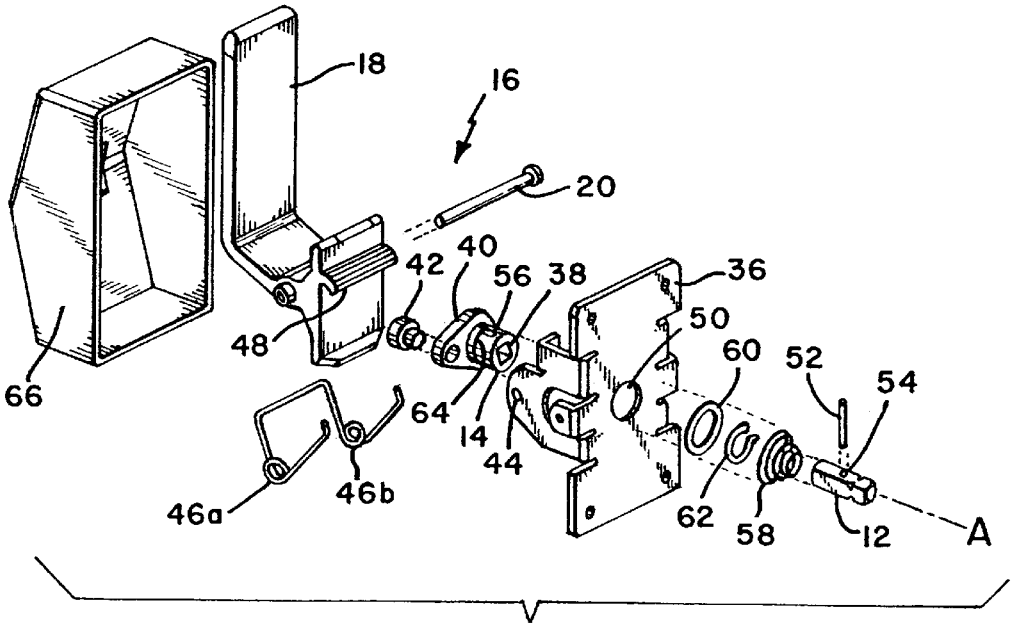
FIG. 2 is an exploded view of a handle trim mechanism incorporating the retracting spindle mechanism of the present invention seen in FIG. 1.
Figure 3:
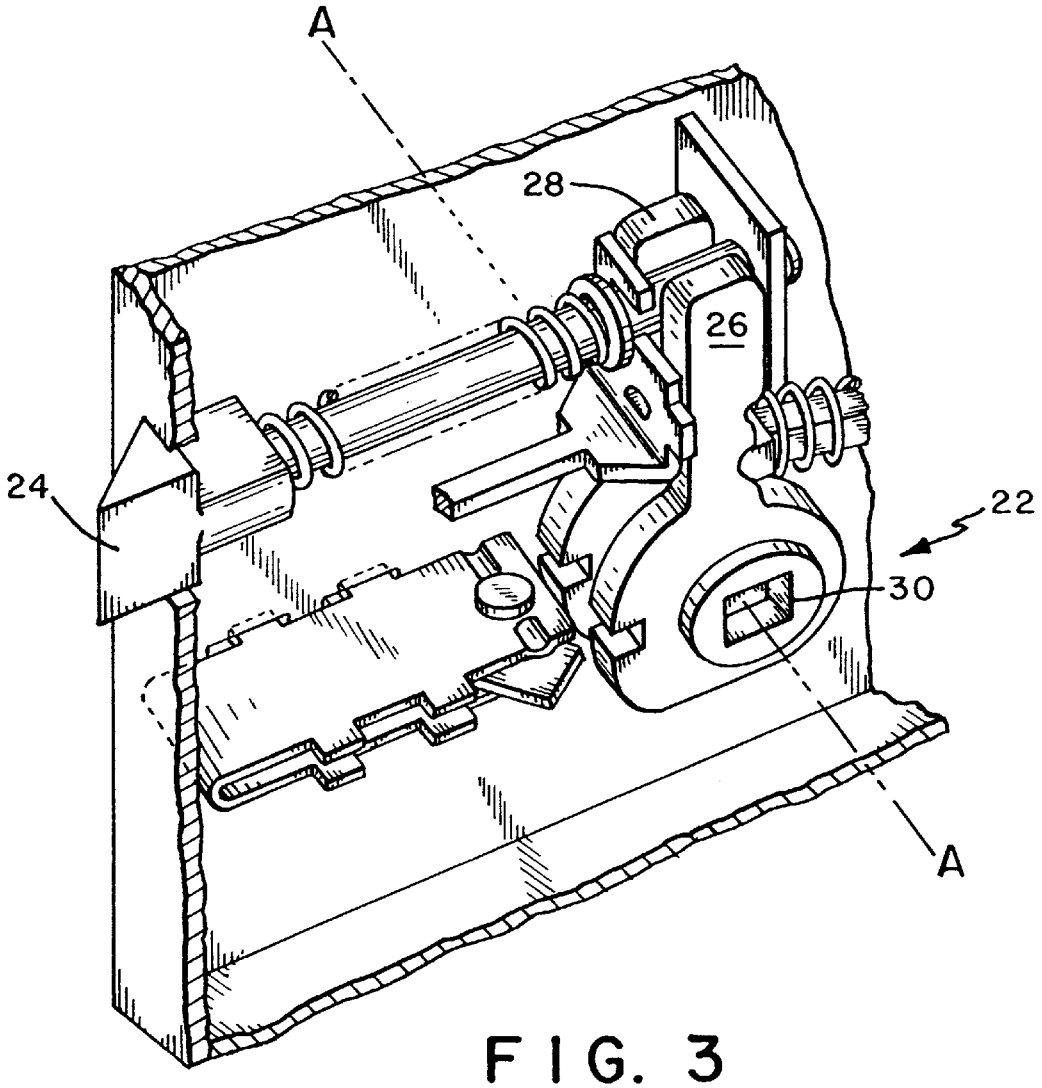
FIG. 3 (PRIOR ART)
FIG. 3 is a perspective view of a portion of a prior art mortise lock having a pair of independent spindle hubs which may be operated by the retracting spindle mechanism seen in FIGS. 1 and 2.

FIG. 3 shows one prior art embodiment of a mortised door lock 22. The mortise lock 22 includes a latch bolt 24 which extends outward from the mortise lock 22 and engages a latch plate in a door frame. To open the door, the latch bolt 24 must be retracted from the latch plate (not shown) by rotating spindle hub 26 or spindle hub 28. The spindle hubs 26, 28 are operated by handle trim mechanisms, such as the paddle trim mechanism 16 of FIG. 2. A first trim mechanism is connected to and rotates spindle hub 28 and a second trim mechanism is connected to and rotates spindle hub 26. The spindle mechanism of FIG. 1 may be mounted in a trim mechanism on either side of the door to engage either spindle hub 26 or 28 in the mortise lock 22.

Spindle 12 has a square cross section and engages a corresponding square opening 30 in spindle hub 26. The spindle connected to spindle hub 26 must operate only spindle hub 26 and must not operate spindle hub 28 so that each trim mechanism operates only its corresponding spindle hub. This allows the mortise lock to lock the handles on opposite sides of the door differently. Thus, opening 30 has a limited depth and the spindle 12 is preferably inserted fully into the opening 30 in order to maximize the contact between the spindle 12 and its corresponding spindle hub.

However, as can be seen in FIG. 2, the paddle trim mechanism 16 is mounted on a mounting plate 36 which is mounted on the outer face of the door. Because doors vary in thickness, the plane defined by mounting plate 36 will be at different distances from the center line plane located between the spindle hubs 26, 28. In order to maximally engage the spindle hub, the distance that the spindle hub 12 projects beyond the mounting plate 36 must vary. This variation is achieved through the axial sliding motion of spindle 12 provided by this invention.

Referring to FIGS. 1 and 2 the retracting spindle mechanism will now be described in detail. Spindle 12 slides axially within a square spindle opening 38 in hub 14. One end of hub 14 includes a cam 40 having a roller 42 mounted thereon. The handle pivot 20 is mounted in openings 44 in a pair of arms that extend outward from the mounting plate 36. The extending arms form a fork within which the handle 18 can pivot.

Paddle handle 18 is spring biased to the open position by springs 46*a*, 46*b*. When an inward force is applied to handle 18, the handle pivots on handle pivot 20 and lip 48 of the handle contacts roller 42. This rotates cam 40 and hub 14 within hub opening 50 in the mounting plate 36, converting the inward motion of the handle to rotational motion. The rotation of hub 14 rotates the spindle 12 about its axis A and operates the corresponding spindle hub 26 to retract the latch bolt 24.

The spindle 12 includes a pin 52 that extends transversely through hole 54 in the spindle 12. The ends of pin 52 extend through slot 56 in hub 14 so that spindle 12 is permanently captured within hub 14, but is allowed limited axially sliding motion as the ends of pin 52 move within slot 56.

Slot 56 extends transversely through hub 14 and spindle opening 38 forming a pair of aligned slots on opposite sides of the hub 14. The ends of pin 52 extend outward through the pair of slots and outward from both sides of the hub. Spring 58 surrounds hub 14 and is trapped by the outwardly extending ends of pin 52.

Spring 58 exerts a continuous outward pressure on the spindle 12 via the ends of pin 52 such that the spindle 12 is continuously urged into maximum engagement with hole 30 in spindle hub 26. However, the spindle 12 can be pushed back into a partially retracted position as necessary to accommodate doors of decreasing thickness due to the sliding motion permitted by the slot 56 and spring 58.

The retracting spindle mechanism of the present invention can be used with various type of handles and trim mechanisms, but as can be seen in FIG. 2, it is particularly suitable for use in paddle trim mechanisms. Paddle trim mechanisms have a very limited distance between the pivoting mechanism of the paddle handle and the center plane of the door. In order for the spindle to move axially between these limits, the spindle must have a length that is less than this limited distance so that it can be retracted without interfering with the paddle handle pivoting mechanism. The length must not be too short, however, or the spindle 12 will not be sufficiently engaged by opening 38 in hub 14.

In order to efficiently use the limited space between the paddle trim mechanism and the mortise lock, the spring 58 is positioned so that it surrounds the spindle 12. This lengthwise overlap between spring and spindle avoids the need for using any of the limited space for the spring. However, this arrangement allows only a limited space for the spring 58 between pin 52 and mounting plate 36.

To fit within this limited space, spring 58 is preferably a conical spring. A conical spring can collapse to a greater extent than a conventional coil spring. Even more advantageously, conical spring 58 is constructed so that coil 58*a* is larger than adjacent coil 58*b* and each succeeding coil becomes progressively smaller.

More specifically, the inner diameter of coil 58*a* is made slightly larger than the outer diameter of coil 58*b* such that the conical spring 58 can be compressed until it is substantially flat with each coil lying inside of its adjacent coil. This permits the maximum axial motion for the spindle 12 while simultaneously providing the maximum engagement between spindle 12 and the two hubs 14, 26 on its opposite ends.

As can be seen in FIG. 2, hub 14 extends through opening 50 in mounting plate 36. A washer 60 and a C-ring retainer 62 which engages slot 64 on hub 14 holds the spindle mechanism on the mounting plate 36. Spring 58 is then attached and pin 52 inserted such that the entire assembly is retained as an integral unit. A cover 66 encases the mechanism and provides a decorative appearance for the trim mechanism.

It will be understood that the mortise lock of FIG. 3 shows only a very limited subset of the components therein which may include locking mechanisms, deadbolt assemblies and the like. Further, the retracting spindle mechanism 10 of FIG. 1 may be modified for use with other types of handles particularly where some portion of the mechanism limits the extent to which the spindle 12 may extend outward beyond the surface of the door.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A retracting spindle mechanism for operating a door lock comprising:

a spindle having an end shaped to engage and operate the door lock;

a pin mounted in the spindle transverse to an axis of the spindle;

a hub for mounting a fixed distance from the door lock, the hub having a slot and an axial opening formed therein for constantly engaging and rotating the spindle whenever the hub rotates, the axial opening allowing the spindle to slide axially therein relative to the hub between a partially retracted position to decrease an effective length of the spindle relative to the hub and a maximum engagement position to increase the effective length of the spindle relative to the hub and the transversely mounted pin engaging the slot in the hub to retain the spindle in the axial opening; and a spring surrounding a first portion of the hub, the spring exerting an outward force on the spindle through the pin to urge the spindle outward towards the maximum engagement position and increase the effective length of the spindle, the spindle moving the pin and the pin compressing the spring as the spindle slides towards the partially retracted position.

2. The retracting spindle mechanism for a door lock according to claim 1 wherein the spring is a conical spring.

3. The retracting spindle mechanism for a door lock according to claim 2 wherein each coil of the conical spring has an inner diameter and an outer diameter, and the inner diameter of each coil is at least as large as the outer diameter of each smaller coil in the spring.

4. The retracting spindle mechanism for a door lock according to claim 1 wherein the hub includes a cam formed thereon.

5. The retracting spindle mechanism for a door lock according to claim 4 wherein the spring is positioned between the cam and the pin.

6. The retracting spindle mechanism for a door lock according to claim 4 wherein the cam has a roller formed thereon, the roller being offset from the axis of the axial opening in the hub.

7. The retracting spindle mechanism for a door lock according to claim 1 wherein:

the spring is a conical spring having a large end and a small end;

the slot extends transversely through the axial opening in the hub forming a pair of opposed slot openings in the hub;

the pin extends through the opposed slot openings and transversely outward from opposite sides of the hub; and the small end of the conical spring contacts the pin on opposite sides of the hub.

8. The retracting spindle mechanism for a door lock according to claim 1 wherein the spindle has a square cross section.

9. The retracting spindle mechanism for a door lock according to claim 1 in combination with a handle trim mechanism wherein:

the handle trim mechanism includes:

a mounting plate for mounting to the exterior of a door, and a handle mounted to the mounting plate for motion between an open position and a closed position;

the hub of the retracting spindle mechanism is rotatably mounted to the mounting plate;

the handle rotates the hub as the handle moves between the open position and the closed position; and the spring is positioned between the mounting plate and the pin.

10. The retracting spindle mechanism and handle mechanism of claim 9 wherein the handle is a paddle handle.

11. A handle trim mechanism comprising:

a mounting plate for mounting to the exterior of a door;

a handle mounted to the mounting plate for motion between an open position and a closed position; and a retracting spindle mechanism comprising:

a spindle having an end shaped to engage and operate the door lock;

a pin mounted in the spindle transverse to an axis of the spindle;

a hub for mounting a fixed distance from the door lock, the hub having a slot and an axial opening formed therein for constantly engaging and rotating the spindle whenever the hub rotates, the axial opening allowing the spindle to slide axially therein relative to the hub between a partially retracted position to decrease an effective length of the spindle relative to the hub and a maximum engagement position to increase the effective length of the spindle relative to the hub and the transversely mounted pin engaging the slot in the hub to retain the spindle in the axial opening; and a spring surrounding a first portion of the hub, the spring exerting an outward force on the spindle through the pin to urge the spindle outward towards the maximum engagement position and increase the effective length of the spindle, the spindle moving the pin and the pin compressing the spring as the spindle slides towards the partially retracted position.

12. The handle trim mechanism according to claim 11 wherein the handle is a paddle handle.

13. The handle trim mechanism according to claim 11 further comprising a cam connected to the hub, the cam being contacted by the handle and rotating the hub as the handle moves between the open position and the closed position.

14. The handle trim mechanism according to claim 13 wherein the spring is a conical spring.

15. The handle trim mechanism according to claim 14 wherein each coil of the conical spring has an inner diameter and an outer diameter, and the inner diameter of each coil is at least as large as the outer diameter of each smaller coil in the spring.

16. The handle trim mechanism according to claim 13 wherein the spring is positioned between the cam and the pin, the spring and cam being on opposite sides of the mounting plate.

17. The handle trim mechanism according to claim 13 wherein the cam has a roller formed thereon, the roller being offset from the axis of the axial opening in the hub.

18. The handle trim mechanism according to claim 11 wherein:

the spring is a conical spring having a large end and a small end;

the slot extends transversely through the axial opening in the hub forming a pair of opposed slot openings in the hub;

the pin extends through the opposed slot openings and transversely outward from opposite sides of the hub; and the small end of the conical spring contacts the pin on opposite sides of the hub.

19. The handle trim mechanism according to claim 11 wherein the spindle has a square cross section.

* * * * *